US010839654B2

(12) United States Patent
Delekta et al.

(10) Patent No.: US 10,839,654 B2
(45) **Date of Patent: *Nov. 17, 2020**

(54) SYSTEM AND METHOD OF ALLOWING A PLAYER TO PLAY GAMING MACHINES HAVING MULTIPLE REEL SETS

(71) Applicant: Konami Gaming, Inc., Las Vegas, NV (US)

(72) Inventors: Scott Delekta, Las Vegas, NV (US); Keith Rucker, Las Vegas, NV (US); Satoshi Suda, Henderson, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/369,878

(22) Filed: Mar. 29, 2019

(65) Prior Publication Data

US 2019/0228613 A1 Jul. 25, 2019

Related U.S. Application Data

(63) Continuation of application No. 15/637,483, filed on Jun. 29, 2017, now Pat. No. 10,290,188, which is a (Continued)

(30) Foreign Application Priority Data

Apr. 8, 2014 (AU) ..... 2014201982

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01)

(58) Field of Classification Search
CPC ..... G07F 17/32; G07F 17/34; G07F 17/3213
See application file for complete search history.

(56) References Cited

U.S. PATENT DOCUMENTS 5,085,436 A 2/1992 Bennett
5,395,111 A 3/1995 Inoue
(Continued)

FOREIGN PATENT DOCUMENTS

AU 2002301067 B2 6/2003
AU 2004203045 B2 7/2004
(Continued)

OTHER PUBLICATIONS

Patent Examination Report No. 1 (AU Patent Application No. 2014201982); dated Jun. 4, 2014; 4 pages.
(Continued)

*Primary Examiner* — Omkar A Deodhar
*Assistant Examiner* — Shauna-Kay Hall
(74) *Attorney, Agent, or Firm* — Howard & Howard Attorneys PLLC

(57) ABSTRACT

A game machine is provided. The machine comprises a display and a controller. The display is configured to display a plurality of symbol cells displayed in a grid. The grid defines a plurality of columns, each column having an associated reel, each reel having an associated reel strip, each reel strip including a plurality of symbol positions and a plurality of game symbols displayed in each of the symbol cells in a predetermined order defining a reel layout, at least one of the reel strips having a second reel layout, the second reel layout having an identical symbol in a plurality of consecutive symbol positions. The controller is configured to replace the reel layout with the second reel layout in the at least one of the reel strips.

20 Claims, 12 Drawing Sheets

Related U.S. Application Data continuation of application No. 14/456,886, filed on Aug. 11, 2014, now Pat. No. 9,728,049.

(60) Provisional application No. 61/889,998, filed on Oct. 11, 2013.

(56) References Cited

U.S. PATENT DOCUMENTS

| | | | | |
|---|---|---|---|---|
| 6,880,826 | B2 | 4/2005 | Inoue | |
| 7,014,559 | B1 | 3/2006 | Fong | |
| 7,690,985 | B1 | 4/2010 | Muskin et al. | |
| 7,950,994 | B2 | 5/2011 | Berman et al. | |
| 8,235,796 | B2 | 8/2012 | Nakamura | |
| 2003/0064778 | A1 | 4/2003 | Berman et al. | |
| 2004/0036218 | A1 | 2/2004 | Inoue | |
| 2004/0048650 | A1 | 3/2004 | Mierau et al. | |
| 2005/0059478 | A1 | 3/2005 | Peterson et al. | |
| 2005/0239539 | A1 | 10/2005 | Inamura | |
| 2006/0058097 | A1 | 3/2006 | Berman et al. | |
| 2006/0183534 | A1 | 8/2006 | Yoshimi | |
| 2006/0287060 | A1 | 12/2006 | Yoshimi | |
| 2007/0060256 | A1* | 3/2007 | Yoshimura | G07F 17/32 463/16 |
| 2007/0063488 | A1 | 3/2007 | Dunlap et al. | |
| 2008/0064463 | A1 | 3/2008 | Bennett | |
| 2008/0064465 | A1 | 3/2008 | Bennett | |
| 2008/0132321 | A1 | 6/2008 | Pau | |
| 2009/0124325 | A1 | 5/2009 | Wadleigh et al. | |
| 2009/0124347 | A1 | 5/2009 | Rodgers et al. | |
| 2009/0227332 | A1 | 9/2009 | Yoshizawa | |
| 2009/0227357 | A1 | 9/2009 | Rasmussen | |
| 2010/0004049 | A1 | 1/2010 | Ching et al. | |
| 2010/0093424 | A1 | 4/2010 | Kono et al. | |
| 2010/0248809 | A1 | 9/2010 | Fitzsimons et al. | |
| 2012/0083327 | A1 | 4/2012 | Zobel et al. | |
| 2012/0258787 | A1 | 10/2012 | Bennett | |
| 2013/0045789 | A1 | 2/2013 | Montenegro et al. | |
| 2013/0079103 | A1 | 3/2013 | Nicely | |
| 2014/0309011 | A1 | 10/2014 | Pawloski | |

FOREIGN PATENT DOCUMENTS

| | | | |
|---|---|---|---|
| AU | 2012275033 | B1 | 9/2013 |
| JP | 2011-045423 | A | 3/2011 |
| JP | 2011189125 | A | 9/2011 |

OTHER PUBLICATIONS

Patent Examination Report No. 1 (AU Patent Application No. 2014201983); dated Jun. 17, 2014; 3 pages.

Patent Examination Report No. 1 (AU Patent Application No. 2014202020); dated Jul. 28, 2014; 4 pages.

Patent Examination Report No. 1 (AU Patent Application No. 2014256338); dated Dec. 18, 2014; 3 pages.

Patent Examination Report No. 2 (AU Patent Application No. 2014202020); dated Dec. 22, 2014; 2 pages.

Patent Examination Report No. 1 (AU Patent Application No. 2015202629); dated Sep. 10, 2015; 3 pages.

Notice of Reasons for Rejection (JP Patent Application No. 2014-167691); dated Sep. 15, 2015; 4 pages.

Patent Examination Report No. 2 (AU Patent Application No. 2015202629); dated Oct. 21, 2015; 2 pages.

Office Action (MO Patent Application No. I/326); dated Nov. 11, 2015; 13 pages.

Patent Examination Report No. 3 (AU Patent Application No. 2014256338): dated Nov. 18, 2015; 4 pages.

Patent Examination Report No. 4 (AU Patent Application No. 20142569338); dated Dec. 15, 2015; 3 pages.

Patent Examination Report No. 3 (AU Patent Application No. 2015202629); dated Feb. 4, 2016; 4 pages.

Decision of Rejection (JP Patent Application No. 2014-167691): dated Jun. 28, 2016: 4 pages.

Final Office Action (U.S. Appl. No. 14/456,902); dated Feb. 12, 2016; 28 pages.

Non-Final Office Action (U.S. Appl. No. 14/456,919); dated Jan. 9, 2017; 48 pages.

* cited by examiner

| | | Weight | Prob | Cycle |
|---|---|---|---|---|
| Mystery Event 1 | | 3 | 3.00% | 33.3 |
| Mystery Event 2 | | 26 | 26.00% | 3.8 |
| Mystery Event 3 | | 28 | 28.00% | 3.6 |
| Mystery Event 4 | | 27 | 27.00% | 3.7 |
| Primary Game | | 16 | 16.00% | 6.3 |
| Totals | | 100 | 100.00% | |

FIG. 9

Primary Game Reel Strips

| Reel 1 | Reel 2 | Reel 3 | Reel 4 | Reel 5 |
|---|---|---|---|---|
| PIC-a | PIC-a | PIC-a | PIC-a | PIC-a |
| 10 | 10 | 10 | 10 | 10 |
| PIC-a | PIC-a | PIC-a | PIC-a | PIC-a |
| PIC-a | PIC-a | PIC-a | PIC-a | PIC-a |
| PIC-a | PIC-a | PIC-a | PIC-a | PIC-a |
| PIC-a | PIC-a | PIC-a | PIC-a | PIC-a |
| PIC-a | PIC-a | PIC-a | PIC-a | PIC-a |
| PIC-a | PIC-a | PIC-a | PIC-a | PIC-a |
| PIC-a | PIC-a | PIC-a | PIC-a | PIC-a |
| PIC-a | PIC-a | PIC-a | PIC-a | PIC-a |
| K | K | K | K | K |
| J | J | J | J | J |
| Q | Q | Q | Q | Q |
| PIC-c | PIC-c | PIC-c | PIC-c | PIC-c |
| PIC-d | PIC-d | PIC-d | PIC-d | PIC-d |
| A | A | A | A | A |
| 10 | 10 | 10 | 10 | 10 |
| A | A | A | A | A |
| PIC-b | PIC-b | PIC-b | PIC-b | PIC-b |
| PIC-d | PIC-d | PIC-d | PIC-d | PIC-d |
| Q | Q | Q | Q | Q |
| Scatter | Scatter | Scatter | Scatter | Scatter |
| 9 | 9 | 9 | 9 | 9 |
| PIC-c | PIC-c | PIC-c | PIC-c | PIC-c |
| J | J | J | J | J |
| K | K | K | K | K |
| Q | Q | Q | Q | Q |
| WILD | WILD | WILD | WILD | WILD |
| WILD | WILD | WILD | WILD | WILD |
| WILD | WILD | WILD | WILD | WILD |
| J | J | J | J | J |
| A | A | A | A | A |

FIG. 10A

Mystery Feature Reel Strip 1

| Reel 1 | Reel 2 | Reel 3 | Reel 4 | Reel 5 |
|---|---|---|---|---|
| Q | Q | Q | Q | Q |
| PIC-c | PIC-c | PIC-c | PIC-c | PIC-c |
| PIC-d | PIC-d | PIC-d | PIC-d | PIC-d |
| A | A | A | A | A |
| 10 | 10 | 10 | 10 | 10 |
| A | A | A | A | A |
| PIC-b | PIC-b | PIC-b | PIC-b | PIC-b |
| PIC-d | PIC-d | PIC-d | PIC-d | PIC-d |
| Q | Q | Q | Q | Q |
| Scatter | Scatter | Scatter | Scatter | Scatter |
| 9 | 9 | 9 | 9 | 9 |
| PIC-c | PIC-c | PIC-c | PIC-c | PIC-c |
| J | J | J | J | J |
| K | K | K | K | K |
| Q | Q | Q | Q | Q |
| WILD | WILD | WILD | WILD | WILD |
| WILD | WILD | WILD | WILD | WILD |
| WILD | WILD | WILD | WILD | WILD |
| J | J | J | J | J |
| A | A | A | A | A |
| PIC-a | PIC-a | PIC-a | PIC-a | PIC-a |
| 10 | 10 | 10 | 10 | 10 |
| WILD | WILD | WILD | WILD | WILD |
| WILD | WILD | WILD | WILD | WILD |
| WILD | WILD | WILD | WILD | WILD |
| WILD | WILD | WILD | WILD | WILD |
| WILD | WILD | WILD | WILD | WILD |
| WILD | WILD | WILD | WILD | WILD |
| WILD | WILD | WILD | WILD | WILD |
| WILD | WILD | WILD | WILD | WILD |
| K | K | K | K | K |
| J | J | J | J | J |

FIG. 10B

Mystery Feature Reel Strip 2

| Reel 1 | Reel 2 | Reel 3 | Reel 4 | Reel 5 |
|---|---|---|---|---|
| K | K | K | K | K |
| Q | Q | Q | Q | Q |
| WILD | WILD | WILD | WILD | WILD |
| WILD | WILD | WILD | WILD | WILD |
| WILD | WILD | WILD | WILD | WILD |
| J | J | J | J | J |
| A | A | A | A | A |
| PIC-a | PIC-a | PIC-a | PIC-a | PIC-a |
| 10 | 10 | 10 | 10 | 10 |
| PIC-b | PIC-b | PIC-b | PIC-b | PIC-b |
| PIC-b | PIC-b | PIC-b | PIC-b | PIC-b |
| PIC-b | PIC-b | PIC-b | PIC-b | PIC-b |
| PIC-b | PIC-b | PIC-b | PIC-b | PIC-b |
| PIC-b | PIC-b | PIC-b | PIC-b | PIC-b |
| PIC-b | PIC-b | PIC-b | PIC-b | PIC-b |
| PIC-b | PIC-b | PIC-b | PIC-b | PIC-b |
| PIC-b | PIC-b | PIC-b | PIC-b | PIC-b |
| K | K | K | K | K |
| J | J | J | J | J |
| Q | Q | Q | Q | Q |
| PIC-c | PIC-c | PIC-c | PIC-c | PIC-c |
| PIC-d | PIC-d | PIC-d | PIC-d | PIC-d |
| A | A | A | A | A |
| 10 | 10 | 10 | 10 | 10 |
| A | A | A | A | A |
| PIC-b | PIC-b | PIC-b | PIC-b | PIC-b |
| PIC-d | PIC-d | PIC-d | PIC-d | PIC-d |
| Q | Q | Q | Q | Q |
| Scatter | Scatter | Scatter | Scatter | Scatter |
| 9 | 9 | 9 | 9 | 9 |
| PIC-c | PIC-c | PIC-c | PIC-c | PIC-c |
| J | J | J | J | J |

FIG. 10C

SYSTEM AND METHOD OF ALLOWING A PLAYER TO PLAY GAMING MACHINES HAVING MULTIPLE REEL SETS

CROSS REFERENCE TO RELATED APPLICATIONS

This application is a continuation of U.S. patent application Ser. No. 15/637,483, filed on Jun. 29, 2017, which is a continuation of U.S. patent application Ser. No. 14/456,886, filed on Aug. 11, 2014 (now U.S. Pat. No. 9,728,049, issued on Aug. 8, 2017), which claims the benefit of U.S. Provisional Application Ser. No. 61/889,998, filed on Oct. 11, 2013, and to Australian Patent Application No. 2014201982, filed Apr. 8, 2014, the disclosures of which are hereby incorporated by reference in their entirety.

COPYRIGHT NOTICE

A portion of this disclosure contains material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The present invention relates to gaming machines for the playing of games of chance and, more particularly, to special features of games or feature games which may be offered on such machines.

BACKGROUND OF THE INVENTION

Gaming machines, such as slot machines, are a cornerstone of the gaming industry. Some known gaming machines include a video display device to display a reel game that includes a plurality of reels, wherein each reel includes a plurality of symbols. During game play, the gaming machine accepts a wager from a player, the player selects one or more paylines, the gaming machine spins the reels, and sequentially stops each reel to display the generated combination of symbols on the reels. The gaming machine then awards the player an award based on the combination of symbols orientated along the selected payline.

Traditionally such machines were mechanical devices where a number of reels marked with a plurality of numbers or symbols could be made to spin randomly by the application of some mechanical input. If the subsequent patterns of numbers or symbols displayed on the reels, when these returned to a rest state, corresponded to predetermined patterns, the machine would provide a prize or payout. Generally such gaming machines have come to be regulated by government authorities as to their number and in the manner in which the machines must return a percentage of the monetary turnover to the players.

The introduction of electronics, computers and electronic graphical displays, has allowed a continual increase in the complexity and variations of gaming machines, games and displays while maintaining the basic concept of the traditional machine. Nevertheless, in some jurisdictions at least, government regulations effectively restrict the degree of variation which may be incorporated in games played on coin-freed machines.

Machines and games therefore that offer novel and stimulating variations on the basic game theme and environment, yet comply with these restrictions are eagerly sought by the gaming industry and there is consequently intense competition between machine manufacturers to innovate.

Games based on simulated rotatable reels typically display a matrix of elements each of which displays a symbol. Predetermined patterns of symbols, if displayed after the reels are spun and come to rest, may then award a prize to the player of the game. Typically, the symbols are arranged in the elements of a reel so that adjoining elements do not display the same symbol.

An exception to this is found for example in Australian Patent Application No. 2004203045 (Aristocrat Technologies Australia Pty Ltd), in which arrangements are envisaged where two special symbols may occur adjacent one to the other. A similar exception is found in Australian Patent Application No. 2002301067 (Stargames Corporation Limited), in which a specific symbol and the number of its occurrences in the display at the conclusion of a game sequence, is determinant of a win. As indicated in FIG. 2 of the specification, two such symbols may appear in adjoining elements of a reel. Both these examples of the prior art allow for only a single predetermined or special symbol to take up such adjacent positions on a reel. It is an object of the present invention to address or at least ameliorate some of the above disadvantages.

BRIEF SUMMARY OF INVENTION

In one aspect of the aspect of the present invention, a game machine is provided. The machine comprises a display and a controller. The display is configured to display a plurality of symbol cells displayed in a grid. The grid defines a plurality of columns, each column having an associated reel, each reel having an associated reel strip, each reel strip including a plurality of symbol positions and a plurality of game symbols displayed in each of the symbol cells in a predetermined order defining a reel layout, at least one of the reel strips having a second reel layout, the second reel layout having an identical symbol in a plurality of consecutive symbol positions. The controller is configured to replace the reel layout with the second reel layout in the at least one of the reel strips.

In another aspect of the present invention, a method of implementing a game machine including a display and a controller is provided. The display is configured to display a plurality of symbol cells displayed in a grid. The grid defines a plurality of columns, each column having an associated reel, each reel having an associated reel strip, each reel strip including a plurality of symbol positions and a plurality of game symbols displayed in each of the symbol cells in a predetermined order defining a reel layout, at least one of the reel strips having a second reel layout, the second reel layout having an identical symbol in a plurality of consecutive symbol positions. The method includes the step of replacing the reel layout with the second reel layout in the at least one of the reel strips.

In another aspect of the present invention, a non-transitory information recording medium containing a computer readable program that functions as a game machine is provided. The machine comprises a display and a controller. The display is configured to display a plurality of symbol cells displayed in a grid. The grid defines a plurality of columns, each column having an associated reel, each reel having an associated reel strip, each reel strip including a plurality of symbol positions and a plurality of game symbols displayed in each of the symbol cells in a predetermined order defining a reel layout, at least one of the reel strips having a second reel layout, the second reel layout having an identical symbol in a plurality of consecutive symbol positions. The controller is configured to replace the reel layout with the second reel layout in the at least one of the reel strips.

BRIEF DESCRIPTION OF THE DRAWINGS

Other advantages of the present invention will be readily appreciated as the same becomes better understood by reference to the following detailed description when considered in connection with the accompanying drawings:

FIG. 9 is a weight table indicating different probabilities used by the present invention;

FIG. 10A is a layout of the inner reels used within the game machine;

FIG. 10B is another layout of the inner reels used within the game machine;

FIG. 10C is another layout of the inner reels used within the game machine;

Corresponding reference characters indicate corresponding parts throughout the drawings.

DETAILED DESCRIPTION OF THE INVENTION

With reference to the drawings and in operation, the present invention overcomes at least some of the disadvantages of known gaming machines by providing a gaming machine and methods that incorporate multiple reel sets, reel overlays, or dynamic reel allocation features.

A selected embodiment of the present invention will now be explained with reference to the drawings. It will be apparent to those skilled in the art from this disclosure that the following description of the embodiments of the present invention is provided for illustration only and not for the purpose of limiting the invention as defined by the appended claims and their equivalents.

Referring to the figures, where like numerals generally indicate like or corresponding parts throughout the several views, the systems and methods are constructed in accordance with the invention.

Gaming Machine

Figure 1:
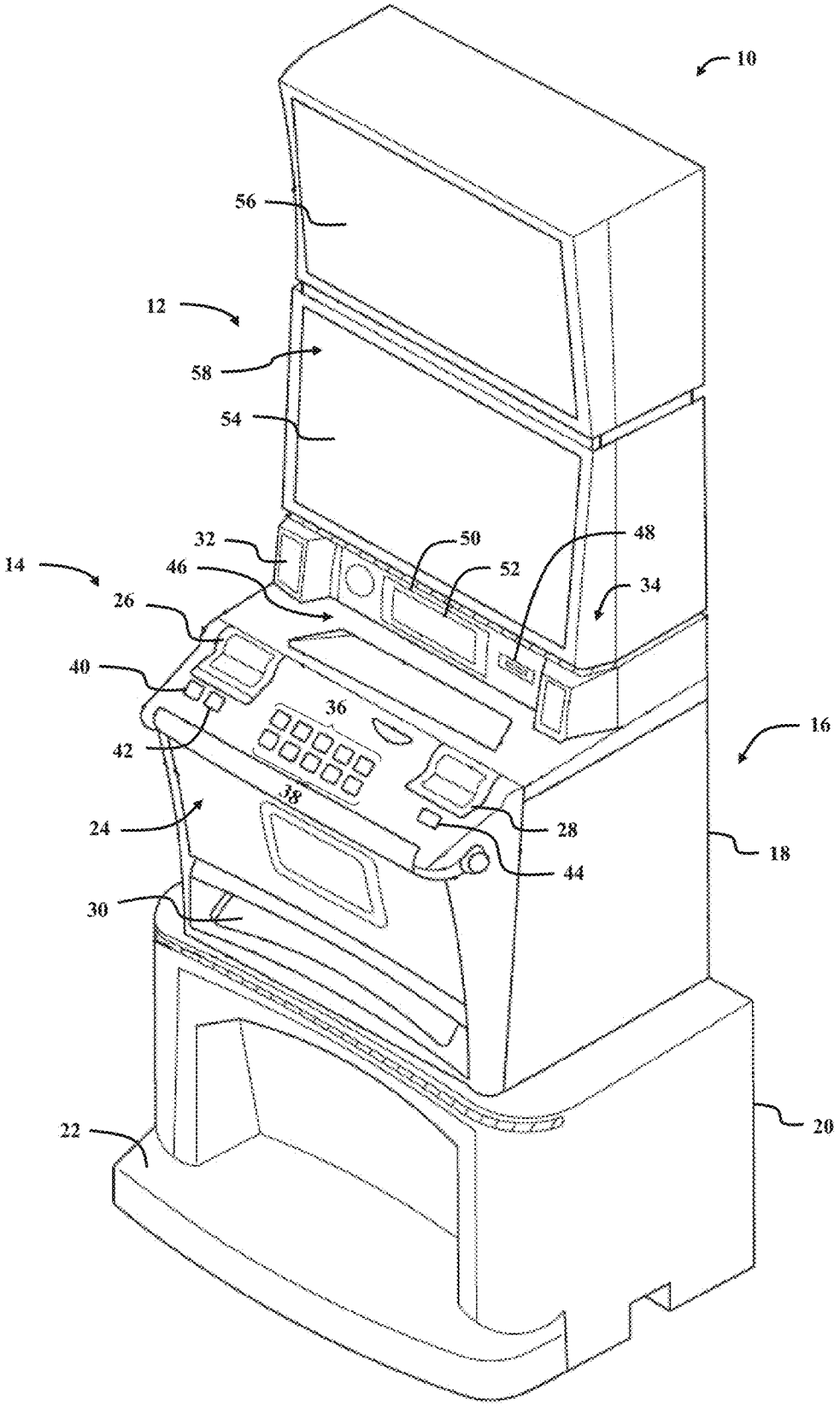
FIG. 1 is a perspective view of an exemplary gaming machine.
Figure 2:
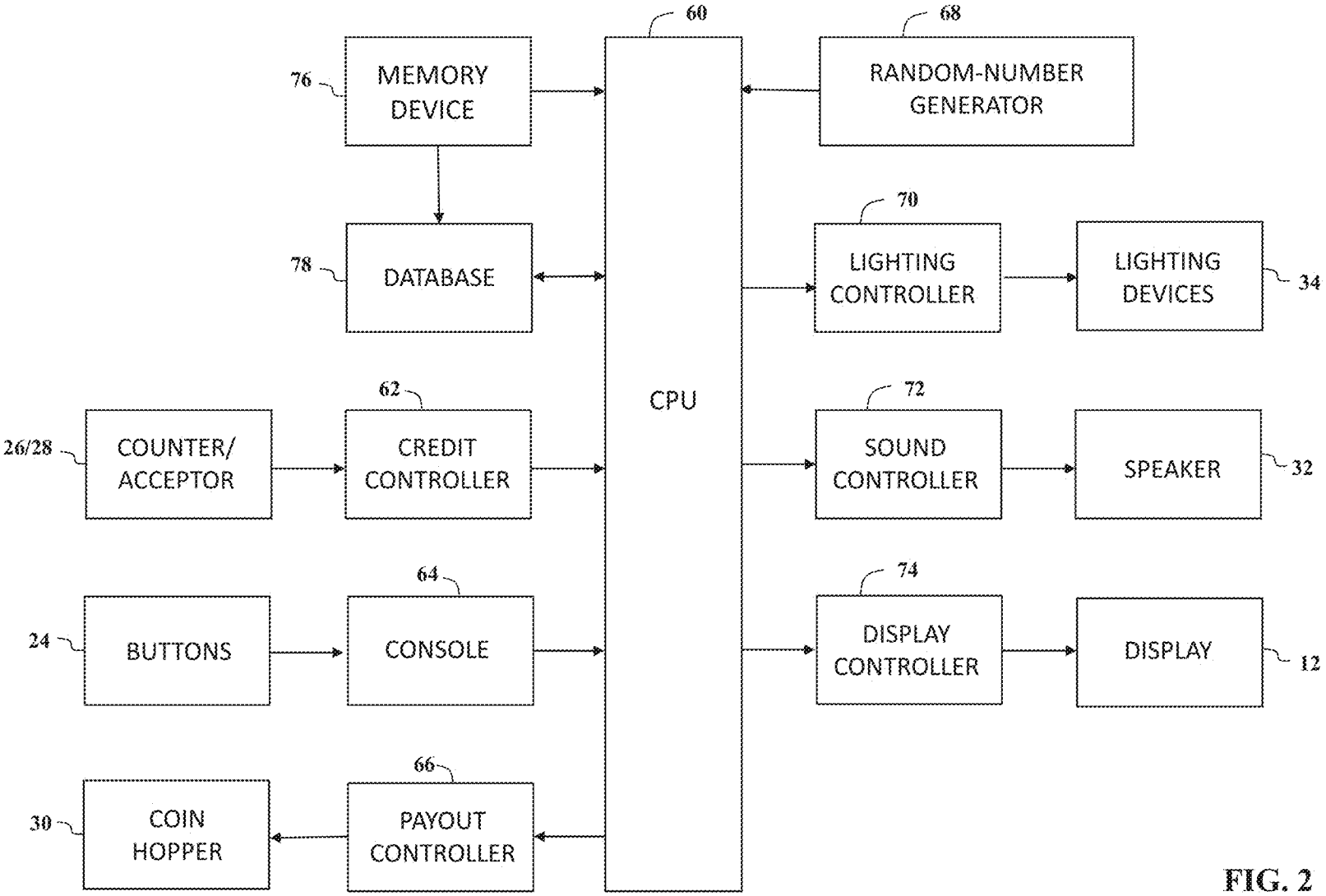
FIG. 2 is a schematic representation of the gaming machine.

FIG. 1 is a perspective view of an exemplary gaming machine 10. FIG. 2 is a schematic representation of the gaming machine 10. A preferred embodiment of the present invention is a video gaming machine preferably installed in a casino. In the illustrated embodiment, the gaming machine 10 includes a display device 12 for displaying a plurality of games, a user input device 14 to enable a player to interface with the gaming machine 10, and a gaming controller 16 that is operatively coupled to the display device 12 and the user input device 14 to enable a player to play games displayed on the display device 12. The gaming machine 10 also includes a cabinet assembly 18 that is configured to support the display device 12, the user input device 14, and/or the gaming controller 16 from a gaming stand 20 and/or a supporting surface 22.

The display device 12 and the user input device 14 are coupled to the cabinet assembly 18 and are accessible by the player. In one embodiment, the gaming controller 16 is positioned within the cabinet assembly 18. Alternatively, the gaming controller 16 may be separated from the cabinet assembly 18, and connected to components of the gaming machine 10 through a network such as, for example, a local area network (LAN), a wide area network (WAN), dial-in-connections, cable modems, wireless modems, T1, T3, fiber, and/or special high-speed Integrated Services Digital Network (ISDN) lines.

In one embodiment, the user input device 14 includes a plurality of input buttons 24, a coin slot 26, and/or a bill acceptor 28. The coin slot 26 includes an opening that is configured to receive coins and/or tokens deposited by the player into the gaming machine 10. The gaming machine 10 converts a value of the coins and/or tokens to a corresponding amount of gaming credits that are used by the player to wager on games played on the gaming machine 10.

The bill acceptor 28 includes an input and output device that is configured to accept a bill, a ticket, and/or a cash card into the bill acceptor 28 to enable an amount of gaming credits associated with a monetary value of the bills, ticket, and/or cash card to be credited to the gaming machine 10. Moreover, the gaming machine 10 may also utilize a cashless wagering system (not shown), such as a ticket in ticket out (TITO) system (not shown). In one embodiment, the bill acceptor 28 also includes a printer (not shown) that is configured to dispense a printed voucher ticket that includes information indicative of an amount of credits and/or money paid out to the player by the gaming machine 10 during a gaming session. The voucher ticket may be used at other gaming machines, or redeemed for cash, and/or other items as part of a casino cashless system (not shown).

A coin tray 30 is coupled to the cabinet assembly 18 and is configured to receive a plurality of coins that are dispensed from the gaming machine 10. One or more speakers 32 are installed inside the cabinet assembly 18 to generate voice announcements and/or sound effects associated with game play. The gaming machine 10 also includes one or more lighting devices 34 that are configured to blink and/or change brightness and color in specific patterns to produce lighting effects to enhance a visual gaming experience for the player.

In one embodiment, the input buttons 24 include a plurality of BET switches 36 for inputting a wager on a game, a plurality of selection switches 38 for selecting a betting line and/or card, a MAXBET switch 40 for inputting a maximum wager, a PAYOUT switch 42 for ending a gaming session and dispensing accumulated gaming credits to the player, and a start switch, i.e., a SPIN/DEAL button 44 to initiate an output of a game.

In the illustrated embodiment, the BET switches 36 include five switches from 1BET to 5BET to enable a player to wager between a minimum bet up to 5× minimum bet. Each selection switch 38 corresponds to a betting line such as, for example, a payline and/or symbol for a reel game, one or more cards for a card game, and/or a symbol for a roulette game, to enable a player to associate a wager with one or more betting lines. The MAXBET switch 40 enables a player to input the maximum bet that a player can spend against one time of a game. The PAYOUT switch 42 enables a player to receive the amount of money and/or credits awarded to the player during a gaming session, which has been credited onto the gaming machine 10.

The gaming machine 10 may also include a player tracking device 46 that is coupled to the gaming controller 16 for identifying the player and/or a player tracking account that is associated with the player. The player tracking account may include, but is not limited to, gaming credits available to the player for use in playing the gaming machine 10. The player tracking device 46 is configured to communicate player account information between a player tracking controller (not shown) and the gaming machine 10. For example, the player tracking device 46 may be used to track bonus points and/or credits awarded to the player during a gaming session and/or track bonus and/or credits downloaded to the gaming machine 10 from the player tracking system.

The player tracking device 46 is coupled to the gaming cabinet assembly 18 and includes a player identification card reader 48, a data display 50, and a keypad 52. The player identification card reader 48 is configured to accept a player tracking card (not shown) inserted by the player, and read information contained on the player tracking card to identify the player account information. The player identification card reader 48 may include, but is not limited to, a barcode reader, a magnetic card reader, and/or a radio frequency identification (RFID) card reader. The keypad 52 is configured to accept a user selection input such as, for example, a unique player personal identification number (PIN) to facilitate enabling the gaming machine 10 to identify the player, and access player account information associated with the identified player to be displayed on the data display 50. In one embodiment, the data display 50 includes a touchscreen panel that includes the keypad 52. Alternatively, the data display 50 and the keypad 52 may be included in the display device 12.

In one embodiment, the display device 12 includes a first display 54 and a second display 56. The first display 54 is configured to display a game screen 58 including indicia and/or symbols for use in a game, e.g., cards used by a card game, roulette wheel and symbols used in a roulette game, and reels used in a reel game. The game screen 58 may include any type of game including, but not limited to, a video slot game, a keno game, a blackjack game, a video poker game, or any type of game which allows a player to make a wager, play a game, and potentially provide the player an award based on an outcome of the game and a paytable. The second display 56 is configured to display game play instructions for performing the game including, but not limited to, playing instructions, paytables, paylines, betting lines and/or any other information to enable the gaming machine 10 to function as described herein. Moreover, each display 54 and 56 may be configured to display at least a portion of the game screen 58 and/or game play instructions. In one embodiment, the first and second displays 54 and 56 each include a flat panel display, such as a cathode ray tube display (CRT), a liquid crystal display (LCD), a light-emitting diode display (LED), a plasma display, and/or any suitable visual output device capable of displaying graphical data and/or text to a user. Alternatively, a single component, such as a touch screen, may function as both the display device 12 and as the user input device 14. In an alternative embodiment, the first display 54 and/or the second display 56 includes a plurality of mechanical reels displaying a plurality of game symbols.

Referring to FIG. 2, in one embodiment, the gaming controller 16 includes a processor, i.e., a central processing unit (CPU) 60, a credit controller 62, a console unit 64, a payout controller 66, a random-number generator (RNG) 68, a lighting controller 70, a sound controller 72, a display controller 74, a memory device 76, and a database 78. Memory device 76 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 60 to store, retrieve, and/or execute instructions and/or data.

The CPU 60 executes various programs, and thereby controls other components of the gaming controller 16 according to player instructions and data accepted by the user input device 14. The CPU 60 in particular executes a game program, and thereby conducts a game in accordance with the embodiments described herein. The memory device 76 stores programs and databases used by the CPU 60. Moreover, the memory device 76 stores and retrieves information in the database 78 including, but not limited to, a game type, a number of reels associated with a game, a number of reel strips associated with each reel, a number of symbol positions being displayed on each reel strip, a type of symbols being displayed on each symbol position, a predefined set of normal symbols, a predefined set of special symbols, image data for producing game images and/or screens on the display device 12, and temporarily stores variables, parameters, and the like that are used by the CPU 60. In addition, the memory device 76 stores indicia, symbol weights, pay tables, and/or winning combination tables which represent relationships between combinations of random numbers and types of awards. In one embodiment, the memory device 76 utilizes RAM to temporarily store programs and data necessary for the progress of the game, and EPROM to store, in advance, programs and data for controlling basic operation of the gaming machine 10, such as the booting operation thereof.

Any combination of the components above may be referred to as the "controller" generally in order to execute the game mechanics for which the system is configured as well as to perform the steps described below. Furthermore, additional components may also contribute to the functionality of the "controller" generally as required by the system and method within the further embodiments of this invention.

The credit controller 62 manages the amount of player's credits, which is equivalent to the amount of coins and bills counted and validated by the bill acceptor 28. The console unit 64 is coupled to the user input device 14 to monitor player selections received through the input buttons 24, and accept various instructions and data that a player enters through the input buttons 24. The payout controller 66 converts a player's credits to coins, bills, or other monetary data by using the coin tray 30 and/or for use in dispensing a credit voucher via the bill acceptor 28.

The lighting controller 70 controls one or more lighting devices 34 to blink and/or change brightness and color in specific patterns in order to produces lighting effects associated with game play. The sound controller 72 controls the speakers 32 to output voice announcements and sound effects during game play. The display controller 74 controls the display device 12 to display various images on screens preferably by using computer graphics and image data stored in the memory device 76. More specifically, the display controller 74 controls video reels in a game screen displayed on the first display 54 and/or the second display 56 by using computer graphics and the image data.

The RNG 68 generates and outputs random numbers to the CPU 60 preferably at the start of each round of game. The CPU 60 uses the random numbers to determine an outcome of a game. For example, if the game is a video slot game, the CPU 60 uses the RNG 68 to randomly select an arrangement of symbols to be displayed on video reels. Moreover, the CPU 60 generally uses random numbers generated by the RNG 68 to play the games, and to determine whether or not to provide an award to a player. In addition, the CPU 60 generates game outcomes including combinations of random numbers, and compares the generated combinations with winning combinations stored in the winning combination table to determine if the generated outcome is a winning outcome that is associated with a type of award.

Figure 3:
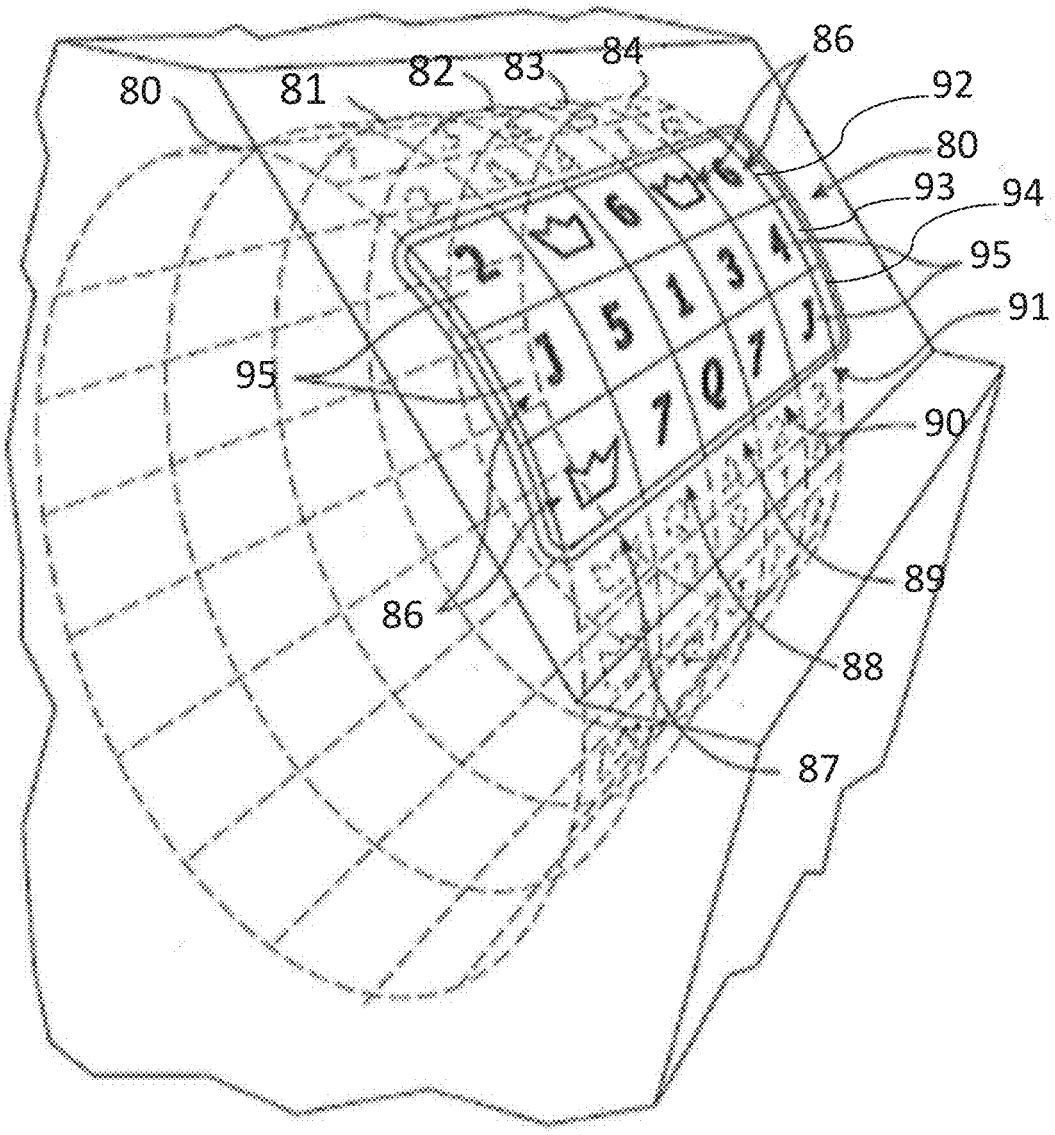
FIG. 3 is a showing of portions of adjoining simulated reels according to an embodiment of the present invention.
Figure 4:
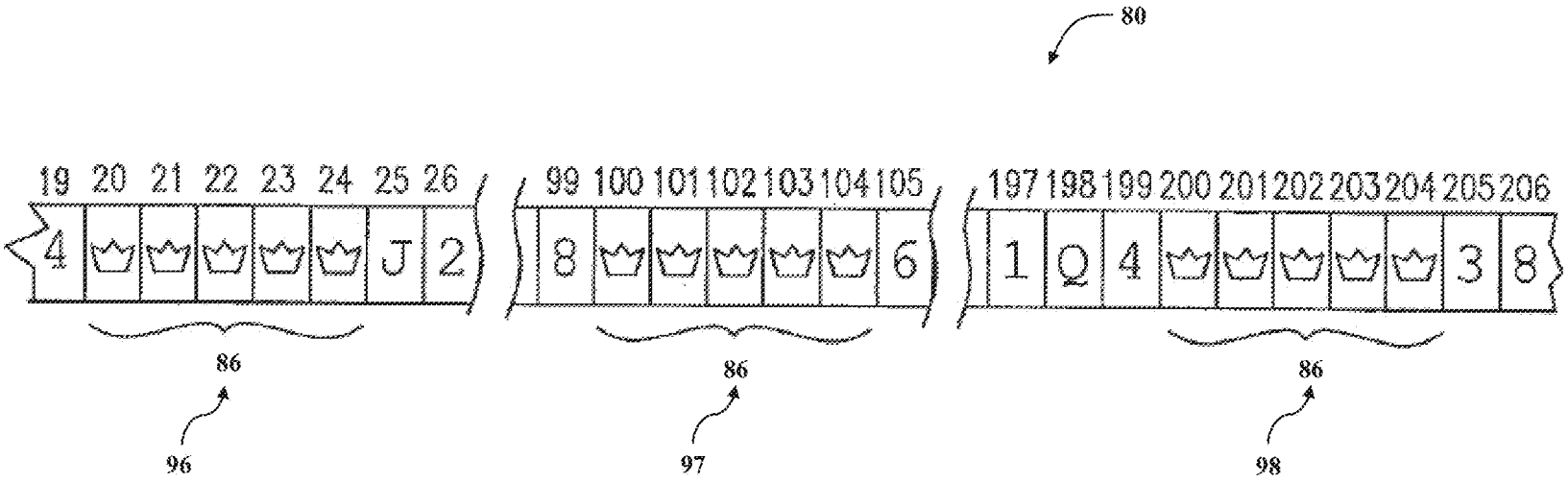
FIG. 4 is a schematic arrangement of elements on an inner reel.

With reference to FIGS. 3 and 4 the display 12 is showing portions of a number of adjoining simulated rotatable reels 80 to 84. Each reel is divided into a given number of elements 86, for example 256 elements. In this example, when rotatable reels 80 to 84 are at rest, the display shows a matrix of elements 86 in five columns, 97-91, and three rows, 92 to 94, so that each column 97-91 comprises a three-element portion of the respective simulated rotatable reels 80 to 84. Each element 86 of simulated rotatable reels 80 to 84 is arranged to display a symbol 95. With some exceptions, as explained below, the sequence of symbols within the elements of a reel remains fixed for all games played.

The controller pre-selects at random, at the initiation of a game sequence, a potential win element for each reel from the set of elements. That is, the game controller predetermines which element, and therefore which symbol, will be displayed in a pay line position at the end of a game sequence, and may therefore contribute to a winning outcome.

In one preferred embodiment of the invention, at least one reel, the first left-most reel, is arranged to have at least one run of an identical symbol in each of a number of consecutive elements. The arrangement is shown schematically in FIG. 4 where portions of the left-most reel 80 are shown in strip form and, for example, a run of kings (crown symbol) is arranged for display in runs of five consecutive elements 86 at three locations 96 to 98 respectively. The three runs of consecutive elements in this example are elements 20 to 24, 100 to 104 and 200 to 204, within the 256-element length of the strip. In this preferred embodiment, the number of elements in a run and the location of the consecutive run or runs within the strip are predetermined and remain constant for each game played on the machine. The identical symbol which populates these consecutive run or runs of elements may be considered as one of a set of "inner reel" symbols.

Figure 5:
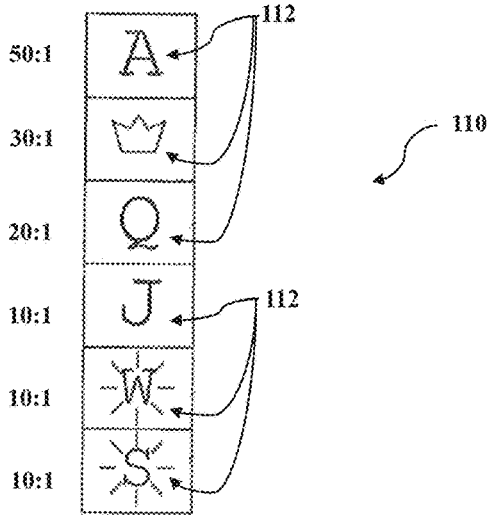
FIG. 5 is a representation of elements on an inner reel strip.

The controller determines the identical symbol to be displayed in each consecutive element of the run or runs of consecutive elements in which the symbol is to be shown. The selection of the identical symbol is through a notional rotation of an "inner reel" 110 shown as a strip of elements and symbols in FIG. 5. This "inner reel" is in effect a look-up table and is not displayed, but its simulated rotation and "coming to rest" determines which symbol will populate the run or runs of consecutive elements of the left-most reel.

The symbols of the "inner reel" or look-up table from which the selection is made, are a sub-set of the set of symbols displayed in the remaining non-"inner reel" elements of the left-most reel. Thus, where the symbols are those of a suit of cards, the "inner reel" symbols may be those of the Ace, King, Queen and Jack, sometimes called the trump or court cards. The look-up table could also include a "wild" or "scatter" symbol. As previously noted, the arrangement or ordering of the symbols in the elements of the reel, other than the consecutive run or runs of elements, remain constant for every game, only the selection of the identical symbol from the look-up table is performed anew for each new play of a game.

The symbols 112 of the look-up table 110 do not all require the same probability of selection and may also be assigned a hierarchy of probability. For example, those symbols where a winning combination grants a player a relatively higher value prize, such as the ace and the king, may have an inversely proportional probability of being selected as an "inner reel" symbol. An example of such a probability table is presented in FIG. 9.

The reels are now spun as normal. The player will notice the run or runs of identical symbols passing through the display 12 for each revolution of the left-most reel 80, thereby providing a heightening of interest, since the odds of a winning arrangement of symbols appearing on a predefined pay line in the matrix at the conclusion of the game sequence will be increased.

In another preferred embodiment of the invention, the second reel, that is the second reel from the left in this example, may also be modified to include at least one run of consecutive elements displaying the same "inner reel" symbol as that used to populate the elements of the consecutive run or runs of the left-most reel. As for the first, left-most reel, the number and location of the consecutive elements of the potential run or runs within the strip of elements forming the simulated reel, is predetermined and remains constant.

Prior to modification, all the elements of the second reel (and likewise those of the third fourth and fifth reel) are randomly populated with symbols from the set of available symbols. Unless modification is triggered in the manner explained below, the ordering of these symbols within the elements of the reels remains constant for every game; only those symbols of the potential run or runs being displaced should a modifying event occur.

Figure 6A:
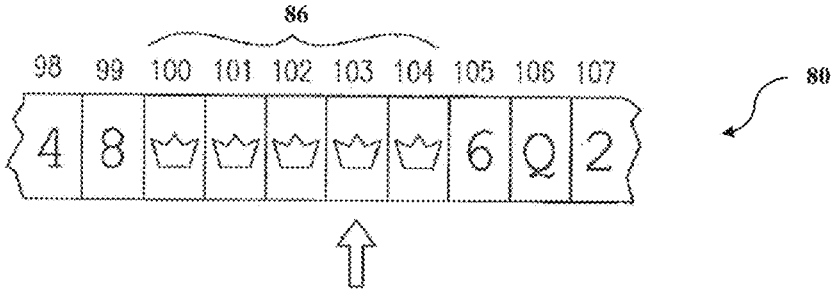
FIG. 6A is a representation of the left-most reel according to an embodiment of the present invention.
Figure 6B:
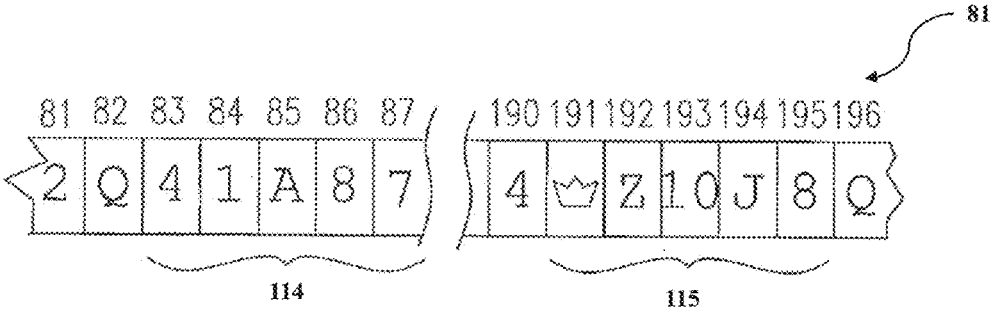
FIG. 6B is a representation of a subsequent reel according to an embodiment of the present invention.
Figure 6C:
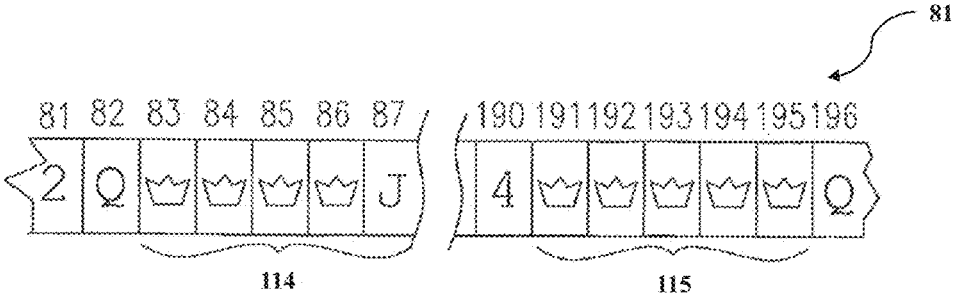
FIG. 6C is a representation of a subsequent reel according to an embodiment of the present invention.

The populating of the potential "inner reel" elements of the second reel, and of any subsequent reels, is dependent on the potential win element for the first, or preceding reel, which was randomly selected by the game controller, lying within a run of consecutive elements of that reel. For example if, as shown in FIG. 6A, in the left-most reel 80, which has consecutive runs comprising the elements as numbered in the embodiment above, the potential win element selected is element number 103, the second reel 81 will be modified. Second reel 81 in this example has two potential runs 114 and 115 of consecutive "inner reel" elements, element numbers 83 to 87 and 191 to 195 respectively, which in a default state are randomly populated from the set of available symbols as shown in FIG. 6B. However, because the selected potential win element 103 of reel 80 falls within a run of elements 86, the potential "inner reel" elements 83 to 87 and 191 to 195 of reel 81 are replaced with the same identical symbol as used for the consecutive run or runs of the left-most reel 80 as shown in FIG. 6C.

A player will now discern a bias of symbols, (in our example crown symbols), in both the first, left-most, and second reels as these are spun during the play of a game. The effect is clearly an increase in the probability of a winning combination of symbols appearing along a pre-defined pay line within the matrix and consequently a raised level of interest in the outcome of the game for the player.

The same process of populating potential "inner reel" elements with the "inner reel" symbol of the preceding reel, may be sequentially applied to the third, fourth and fifth reels. As described for the second reel, the modification of a succeeding reel depends on the selected potential win element of the preceding reel falling within a run of "inner reel" elements of that reel.

In one preferred form of this embodiment, a player is made aware of the populating of one or more consecutive runs of the left-most reel with the identical symbol. This may be done prior to the main game sequence, for example, by a slower pre-spin of only the left-most reel. If any further reels are so populated, each may be pre-spun sequentially.

The displayed game rules and experience will alert a player to the fact that the potential winning element for a given reel is positioned somewhere within the run, or one of the runs of consecutive elements populated with the identical symbol if the second and any subsequent reels are also pre-spun to display a run or runs of that symbol. The player will appreciate that the probability of a winning combination occurring increases with each additional reel which is pre-spun to display its run or runs of elements with the same symbol.

The above described embodiments may be applied to a main game of a gaming machine or to a bonus feature game offered as a result of some triggering event in a main game.

In another preferred embodiment of the invention as adapted for a bonus feature game, the number of elements comprising a run of identical "inner reel" symbols and the number of such runs in any given reel is not constant but may be determined in a number of ways. Thus, in at least one preferred embodiment, the number of elements comprising a run may be a function of the amount of a bet placed by the player on the main game which triggered the feature game, or as a function of accumulated throughput of bets over a given time period. In one special case, all the elements of the first left-most reel may be populated by the same "inner reel" symbol.

Likewise, the number of runs in a given reel may be a function also of the betting pattern preceding the conferring of the feature game or alternatively, may be a function of the particular triggering event of the main game which led to the bonus feature game.

Multiple Reel Strips

In another embodiment of the present invention, multiple reel strips may be used to add or remove runs of identical symbols 114 or 115 and/or increase or decrease the number identical symbols 95 in a run or runs of consecutive symbols 114 or 115. In other words, between spins of a game (which may be spins in a main game, a bonus game or feature, a transition between a main game and a bonus game or feature), or prior to initiation of a spin, one or more of the rotatable reels 80-84 may transition from a first reel strip to a second reel strip. The first reel strip may or may not have a run of consecutive symbols 114 or 115. The second reel strip has at least one run of consecutive symbols 114 or 115. The symbol within the at least one run of consecutive symbols 114 or 115 may be constant or may be variable, e.g., random or pseudo-random.

In one illustrative embodiment, before each spin the set of reel strips used for that spin are randomly chosen. In a specific embodiment the probability of each set of reel strips is weighted. A sample weight table is shown in FIG. 9.

In another illustrative embodiment, the game rules proceed in the following order: first, a feature may be randomly triggered that will replace the primary game reel strips with bonus reel strips. This trigger event can be varied depending on the game mechanics of the game and the implementation of the game machine (either as a stand-alone machine or within a progressive jackpot set-up as discussed below). Second, each event's reel strip layout has stacked symbols of a certain rank. The starting position of each stacked symbol layout may be different for each event. This allows for the possibility of different run of consecutive symbols 114 or 115 depending on the trigger condition that occurs.

It should be noted that at the start of each game one of the mystery events or the primary game may be selected. Each of these is associated with a unique reel strip layout. Sample reel strip layouts with different run of consecutive symbols 114 or 115 are shown in FIGS. 10A through 10C.

As shown in FIGS. 10A through 10C for this illustrative embodiment, each reel strip is the same size. The symbol count, i.e., the total number of each symbol, is constant between corresponding reel strips between the sets of reel strips. The location of each run of consecutive symbols 114 or 115 is different, but the order and sum of the other symbols are the same. However, it should be noted that the size of the reel strips may be different and/or the total number of each symbol may be different and/or the order of symbols may be different within alternate embodiments of the invention.

In another embodiment of the present invention, the display device 12 is configured to display a plurality of symbol cells displayed in a grid. The grid defines a plurality of columns, each column having an associated reel, each reel having an associated reel strip, each reel strip including a plurality of symbol positions and a plurality of game symbols displayed in each of the symbol cells in a predetermined order. This defines a reel layout with at least one of the reel strips having a second reel layout, the second reel layout having an identical symbol in a plurality of consecutive symbol positions. The gaming controller 16 configured to replace the reel layout with the second reel layout in the at least one of the reel strips.

In another embodiment of the present invention, the game machine further includes a plurality of second reel layouts and the gaming controller 16 is further configured to select one second reel layout from the plurality of second reel layouts. This allows the gaming machine 10 to select from multiple layouts with alternate runs of consecutive symbols 114 or 115 during gameplay.

In another embodiment of the present invention, each second reel layout may have a different identical symbol. Also, each second reel layout may have a different number of consecutive symbol positions.

In another embodiment of the present invention, the reel layout and the second reel layout may differ in the number of symbol positions.

In another embodiment of the present invention, the identical symbol within the second reel layout is selected from a subset of available symbols. The subset of available symbols may be all symbols available to the gaming controller 16 during a main game or a special subset that is only accessible for the creation of the second reel layout.

In another embodiment of the present invention, the gaming controller 16 is further configured to select a second identical symbol from the subset of available symbols and replace the second identical symbol with the first identical symbol within the second reel layout. This allows for the generation of multiple identical reel layouts during the same game play session. This secondary replacement of symbols can occur during a main game, a bonus feature game, or resulting from a trigger condition during game play.

In another embodiment of the present invention, each available symbol within the subset of symbols is assigned a probability of selection. This probability is similar to that represented in FIG. 9. Each available symbol would be assigned a probability depending on its value and any additional game mechanics that would alter the symbol's probability.

In another embodiment of the present invention, each second reel layout is assigned a probability of selection, and the gaming controller 16 is configured to select a second reel layout as a function of the probability. This expands on the previous probability for the symbols and is related to the probability table shown in FIG. 9 where different weighted reel layouts can be used during game play depending on the value of the particular reel layout and the desired regularity of that layout during game play.

Figure 7:
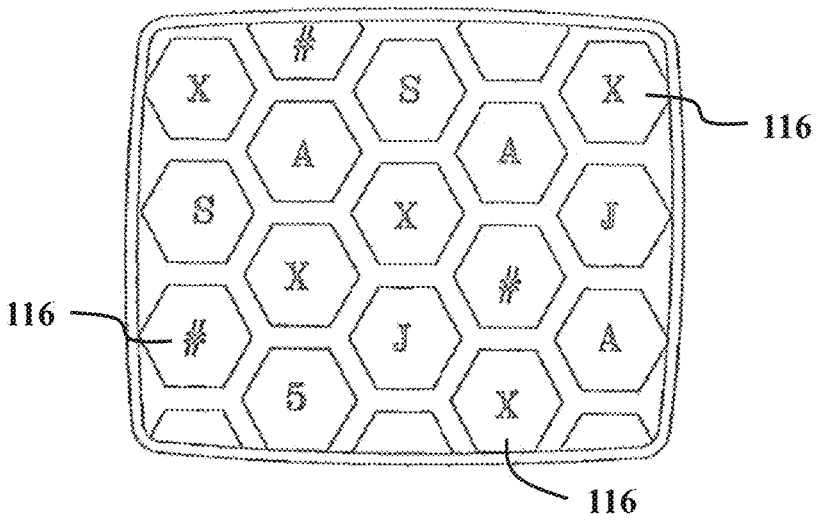
FIG. 7 is a view of the game screen according to an embodiment of the present invention.
Figure 8:
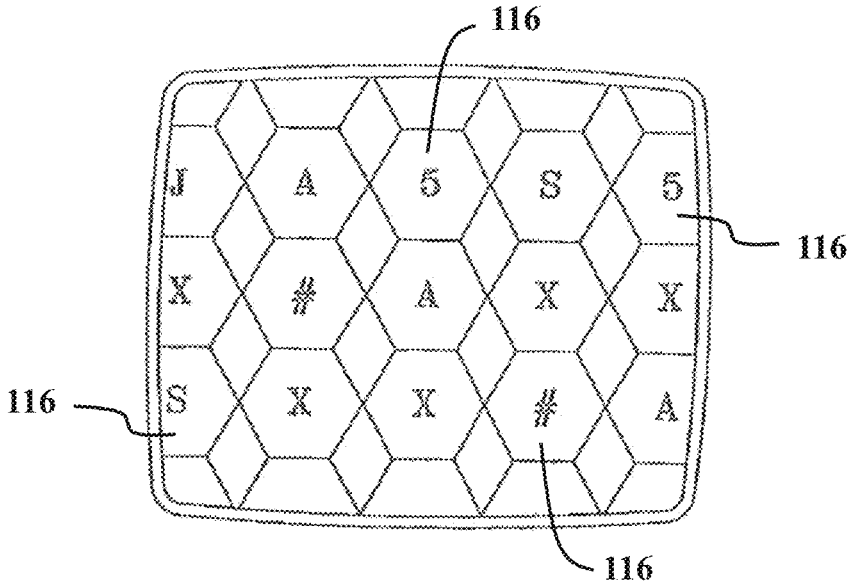
FIG. 8 is an alternate view of the game screen according to an embodiment of the present invention.

In another embodiment of the present invention, the grid is comprised of five columns 87-91 and three rows 92-94 of cells. This is only meant as exemplary and is not supposed to be limiting in any way. FIG. 3, FIG. 7, and FIG. 8 show examples of alternate grids that may be used within the present invention.

In another embodiment of the present invention, the left-most reel strip includes a reel layout. Alternatively, at least one of the other reel strips may include a reel layout. The first reel layout may be present in any one of the reel strips and in any number of reel strips (from one to all reel strips) within the game machine 10.

In another embodiment of the present invention, the gaming controller 16 is configured to detect a trigger condition and replace the reel layout with the second reel layout in response to the trigger condition. The trigger condition may be an element within the main game, a bonus feature, or a combination of both. The trigger condition may also utilize any of the game mechanics and/or symbols available during game play.

In another embodiment of the present invention, the reel layout that responds to the trigger condition is in the left most reel strip. Alternatively, the reel layout that responds to the trigger condition may also be in at least one other reel strip. The first reel layout may be present in any one of the reel strips and in any number of reel strips (from one to all reel strips) within the game machine 10.

In one embodiment of the present invention, the trigger condition for a particular reel is based on the reel layout of the leftwardly preceding reel strip. Also, the replacement of a reel layout within a reel strip may also constitute a trigger condition for a subsequent reel strip.

In another embodiment of the present invention, the game machine selects at least one potential win symbol from each column within the grid. Here, a prize is awarded to a player of a game on the game machine if a predetermined arrangement of potential win symbols is displayed on a pre-defined payline on the grid at the end of a game.

In one embodiment of the present invention, the game machine is one of a plurality of gaming machines linked to a progressive jackpot controller.

In another embodiment of the present invention, the game machine is a single display stand-alone gaming machine.

In another embodiment of the present invention, the game machine further includes an upper secondary display.

In one embodiment of the present invention, each symbol 95 is an N-sided symbol; where N is a variable and values of N include N=1. The elements comprising the matrix of elements 86 of any of the above described embodiments may be of conventional rectangular configuration, but in at least one preferred embodiment the delineation of an element, that is, the boundary defining the field containing a symbol, may be any N-sided figure, where N may take the value 1 (thus a circular field) or any value from 3 to 20. In at least one preferred form of N-sided element, as shown in FIGS. 7 and 8, the elements 116 are hexagon shape for the value of N=6.

In one embodiment of the present invention, each second reel layout is assigned a probability of selection and the controller is configured to select a second reel layout as function of the probability. The probabilities assigned to the second reel layouts are similar to those represented in FIG. 9.

In another embodiment of the present invention, a method of implementing a game machine is provided. The method includes a display configured to display a plurality of symbol cells displayed in a grid, the grid defining a plurality of columns, each column having an associated reel, each reel having an associated reel strip, each reel strip including a plurality of symbol positions and a plurality of game symbols displayed in each of the symbol cells in a predetermined order defining a reel layout, at least one of the reel strips having a second reel layout, the second reel layout having an identical symbol in a plurality of consecutive symbol positions, and a controller. The method includes the step of replacing the reel layout with the second reel layout in the at least one of the reel strips.

In another embodiment of the present invention, the game machine 10 further includes a plurality of second reel layouts and the method further includes the step of selecting one second reel layout from the plurality of second reel layouts. Each second reel layout may have a different identical symbol and/or different number of consecutive symbol positions. The reel layout and the second reel layout may also differ in the number of symbol positions. The method of selecting the second reel layout remains the same regardless of the differences in symbol 95 or in symbol positions.

In another embodiment of the present invention, the game machine 10 further includes a subset of available symbols 95 and the method further includes the step of selecting the identical symbol within the second reel layout from the subset of available symbols 95. These available symbols may be the same symbols utilized during game play for additional symbols reserved for use within the second reel layout.

In another embodiment of the present invention, the method further includes the steps of selecting a second identical symbol 95 from the subset of available symbols 95 and replacing the second identical symbol with the first identical symbol within the second reel layout. This allows for the generation of multiple identical reel layouts during the same game play session. This secondary replacement of symbols can occur during a main game, a bonus feature, or resulting from a trigger condition during game play.

In another embodiment of the present invention, the method further includes the step of assigning each symbol within the subset of symbols a probability of selection.

In another embodiment of the present invention, the method further includes the steps of assigning each second reel layout a probability of selection and selecting the second reel layout based on the probability. This expands on the previous probability for the symbols and related to the probability table shown in FIG. 9 where different weighted reel layouts can be used during game play depending on the value of the particular reel layout and the desired regularity of that layout during game play.

In another embodiment of the present invention, the method further includes the steps of detecting a trigger condition and replacing the reel layout with the second reel layout in response to the trigger condition. The trigger condition may be an element within the main game, a bonus feature, or a combination of both. The trigger condition may also utilize any of the game mechanics and/or symbols available during game play.

In another embodiment of the present invention, the method further includes the step of replacing the reel layout in the left most reel strip with the second reel layout in response to the trigger condition. Alternatively, the method may also include the step of replacing the reel layout in at least one other reel strip in response to the trigger condition. The first reel layout may be present in any one of the reel strip and in any number of reel strips (from one to all reel strips) within the game machine 10.

In another embodiment of the present invention, the method further includes the step of selecting at least one potential win symbol from each reel within the grid.

In another embodiment of the present invention, the method further includes the step of awarding a prize to a player of a game on the game machine if a predetermined arrangement of potential win symbols is displayed on a pre-defined payline on the grid at the end of a game.

In another embodiment of the present invention, the method further includes the steps of assigning a probability of selection to each second reel layout; and selecting a second reel layout as function of the probability. The probabilities assigned to the second reel layouts are similar to those represented in FIG. 9.

In another embodiment of the present invention, a non-transitory information recording medium containing a computer readable program is provided. The computer causes a computer to function as a game machine, comprising a display configured to display a plurality of symbol cells displayed in a grid, the grid defining a plurality of columns, each column having an associated reel, each reel having an associated reel strip, each reel strip including a plurality of symbol positions and a plurality of game symbols displayed in each of the symbol cells in a predetermined order defining a reel layout, at least one of the reel strips having a second reel layout, the second reel layout having an identical symbol in a plurality of consecutive symbol positions, and a controller configured to replace the reel layout with the second reel layout in the at least one of the reel strips.

Reel Overlays

In another preferred embodiment of the present invention, reel overlays may be used to add or remove runs of consecutive symbols 114 or 115 and/or increase or decrease the number identical symbols 95 in a run or runs of consecutive symbols 114 or 115. In this embodiment, one or more of the reels uses a reel strip and one or more overlays reel strips. Each overlay reel strip contains one or more sets of stacked symbols 95 and blanks 118.

In another aspect of the aspect of the present invention, a game machine 10 is provided. The machine comprises a display device 12 and a gaming controller 16. The display device 12 is configured to display a plurality of symbol cells displayed in a grid. The grid defines a plurality of columns, each column having an associated reel, each reel having an associated reel strip, each reel strip including a plurality of symbol positions and a plurality of game symbols displayed in each of the symbol cells in a predetermined order. The gaming controller 16 is configured to: establish a first reel layout and a second reel layout, the second reel layout having a blank symbol in a plurality of consecutive symbol positions and at least one identical symbol in a plurality of consecutive symbol positions; randomly shift the second reel layout by a number of symbol positions in relation to the first reel layout; combine the second reel layout with the first reel layout to create a combined reel layout; and assign the combined reel layout to one of the reel strips.

In another embodiment of the present invention, each blank symbol is configured to cover the corresponding symbol positions of the first reel layout after creating the combined reel layout. Alternatively, each blank symbol may be configured to show the corresponding symbol positions of the first reel layout after creating the combined reel layout.

In another embodiment of the present invention, the gaming controller 16 is configured to detect a trigger condition and combine the second reel layout with the first reel layout in response to the trigger condition. The trigger condition may be an element within the main game, a bonus feature, or a combination of both. The trigger condition may also utilize any of the game mechanics and/or symbols available during game play.

In another embodiment of the present invention, the first reel layout is combined with the second reel layout on the left most reel strip. Alternatively, the first reel layout is combined with the second reel layout on at least one other reel strip. The first reel layout may be present in any one of the reel strips and in any number of reel strips (from one to all reel strips) within the game machine 10.

In another embodiment of the present invention, the combination of reel layouts within a reel strip constitutes a trigger condition for the subsequent reel strip.

In another aspect of the present invention, a method of implementing a game machine 10 including a display device 12 and a gaming controller 16 is provided. The display device 12 is configured to display a plurality of symbol cells displayed in a grid. The grid defines a plurality of columns, each column having an associated reel, each reel having an associated reel strip, each reel strip including a plurality of symbol positions and a plurality of game symbols displayed in each of the symbol cells in a predetermined order. The method includes the steps of: establishing a first reel layout and a second reel layout, the second reel layout having a blank symbol in a plurality of consecutive symbol positions and at least one identical symbol in a plurality of consecutive symbol positions; randomly shifting the second reel layout by a number of symbol positions in relation to the first reel layout; combining the second reel layout with the first reel layout to create a combined reel layout; and assigning the combined reel layout to one of the reel strips.

In another embodiment of the present invention, the method further includes the steps of selecting a second identical symbol 95 from the subset of available symbols 95. This allows for the generation of multiple identical reel layouts during the same game play session. This secondary replacement of symbols can occur during a main game, a bonus feature, or resulting from a trigger condition during game play.

In another embodiment of the present invention, the method further includes the step of assigning each symbol within the subset of symbols a probability of selection.

In another embodiment of the present invention, the method further includes the steps of assigning each second reel layout a probability of selection and selecting the second reel layout based on the probability. This expands on the previous probability for the symbols and related to the probability table shown in FIG. 9 where different weighted reel layout can be used during game play depending on the value of the particular reel layout and the desired regularity of that layout during game play.

In another embodiment of the present invention, the method further includes the steps of detecting a trigger condition and combining the second reel layout with the first reel layout in response to the trigger condition. The trigger condition may be an element within the main game, a bonus feature, or a combination of both. The trigger condition may also utilize any of the game mechanics and/or symbols available during game play.

In another embodiment of the present invention, the method further includes the step of combing the reel layout with the second reel layout in the left most reel strip in response to the trigger condition. Alternatively, the method may also include the step of combing the reel layout with the second reel layout in at least one other reel strip in response to the trigger condition. The first reel layout may be present in any one of the reel strips and in any number of reel strips (from one to all reel strips) within the game machine In another aspect of the present invention, a non-transitory information recording medium containing a computer readable program that functions as a game machine is provided. The machine comprises a display and a controller. The display is configured to display a plurality of symbol cells displayed in a grid. The grid defines a plurality of columns, each column having an associated reel, each reel having an associated reel strip, each reel strip including a plurality of symbol positions and a plurality of game symbols displayed in each of the symbol cells in a predetermined order. The controller is configured to: establish a first reel layout and a second reel layout, the second reel layout having a blank symbol in a plurality of consecutive symbol positions and at least one identical symbol in a plurality of consecutive symbol positions; randomly shift the second reel layout by a number of symbol positions in relation to the first reel layout; combine the second reel layout with the first reel layout to create a combined reel layout; and assign the combined reel layout to one of the reel strips.

In another illustrated embodiment, at the start of each bought game the following occurs:

1. An overlay reel strip is selected for each reel.
2. The overlay is randomly shifted by a number of positions.
3. The overlay is then combined with the primary game reel strip.

Figure 11A:
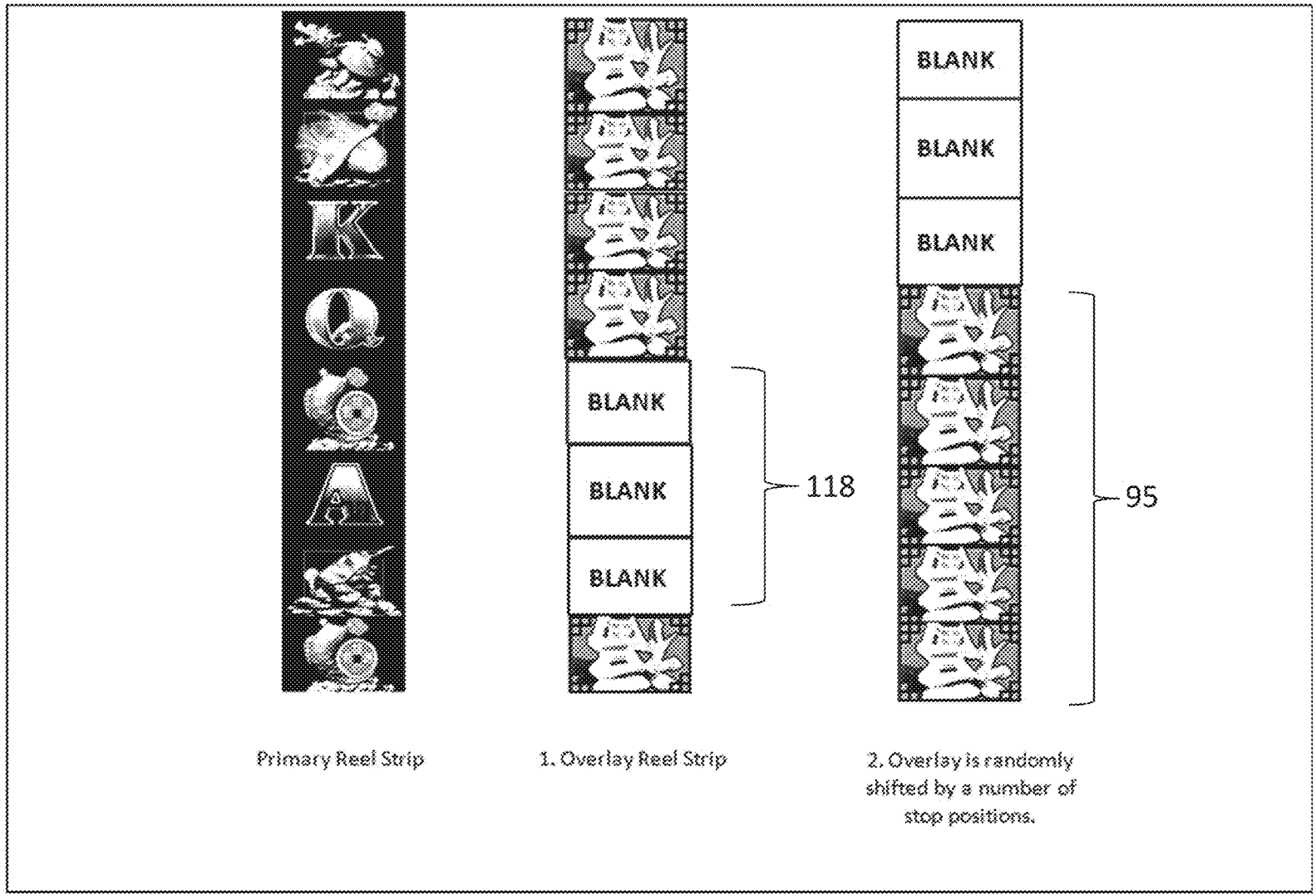
FIG. 11A is a representation of the reel overlay embodiment of the present invention.

As shown in FIG. 11A, a primary reel strip is shown on the left and an overlay reel strip is shown in the middle. The overlay reel strip includes at least one run of consecutive symbols containing an identical symbol 95 and at least one run of blanks 118. Before at least one spin of the game, the overlay is shifted by a number of stop positions. For example, the overlay may be shifted by a random number of stop positions. In the illustrated embodiment, number of symbols in the run(s) of consecutive symbols 114 or 115 and the number of blanks 118 are constants. However, the number of symbols in the run(s) of consecutive symbols and the number of blanks may vary. In one embodiment of the present invention, multiple overlay reel strips may be provided, with different configurations, i.e., the symbol in the run(s) of consecutive symbol positions and/or the number of blanks. Before the spin, one of the multiple overlay reel strips is selected, e.g., randomly selected.

Figure 11B:
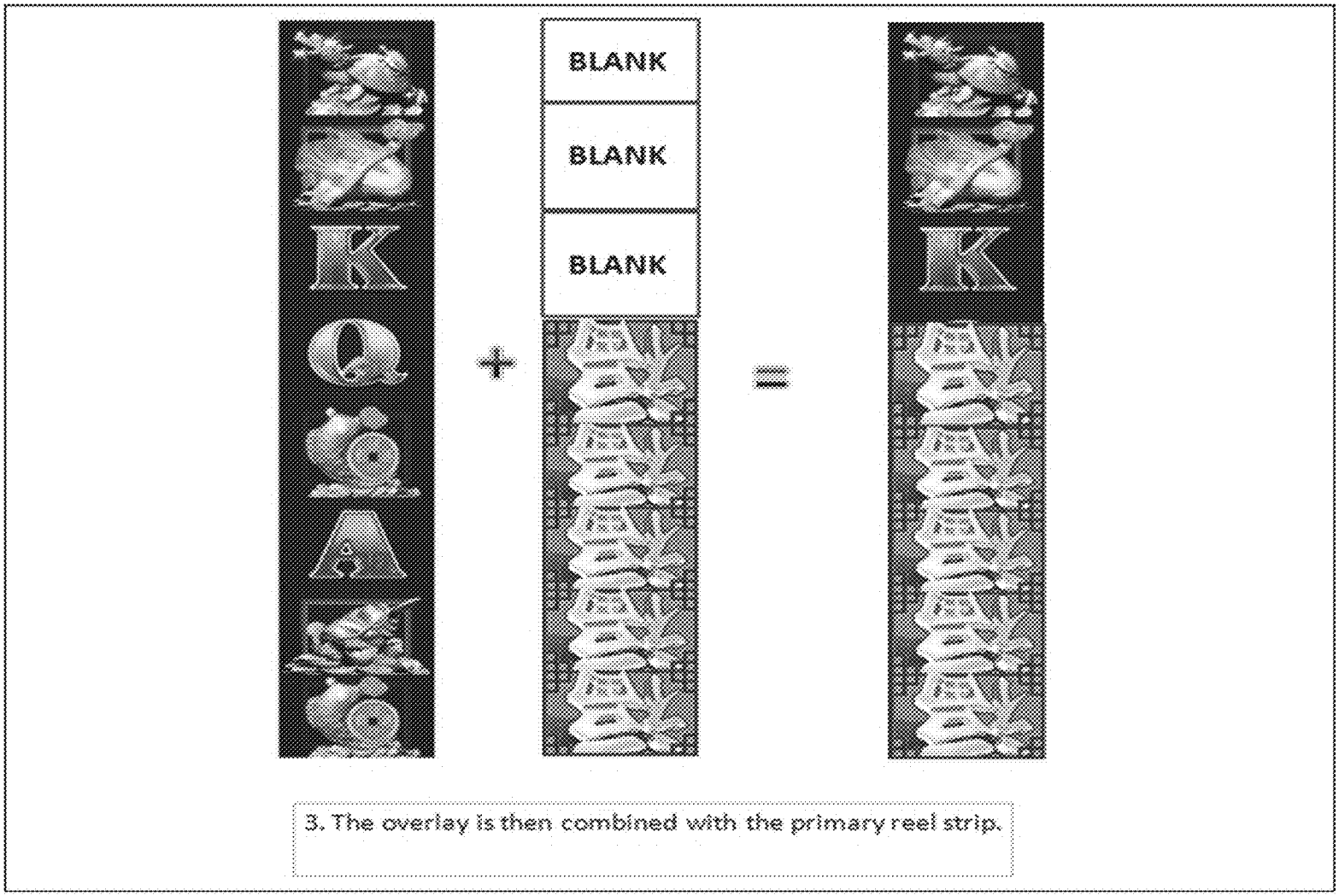
FIG. 11B is a representation of the reel overlay embodiment of the present invention.

In another aspect of the invention, the size of the reel strips may also be modified. In FIG. 11B, the overlay reel strip is combined with the primary reel strip to form the reel strip used in the game.

Dynamic Reel Modification

In another preferred embodiment, a reel strip may be dynamically modified. In this embodiment, each reel has an associated reel strip. One or more of the reel strips may be dynamically modified before a next spin to add or remove runs of identical symbols 95 and/or increase or decrease the number identical symbols 95 in a run or runs of consecutive symbols 114 or 115.

In one specific embodiment, the game rules are as follows:

1. An insertion symbol 120 is selected for each reel.
2. The number of insertion symbols 120 is selected for each reel.
3. The position to insert the insertion symbol 120 is selected for each reel.
4. The insertion symbols 120 are inserted into each reel.

In another specific embodiment, the game rules are as follows:

1. A reel (Reel1) having consecutive identical symbol 95 is selected.
2. The insertion point 122 to insert is selected for each reel (Reel2).
3. The reel (Reel1) is inserted into Reel2.
4. The size and symbols in Reel1 may be static or dynamic.

Figure 12:
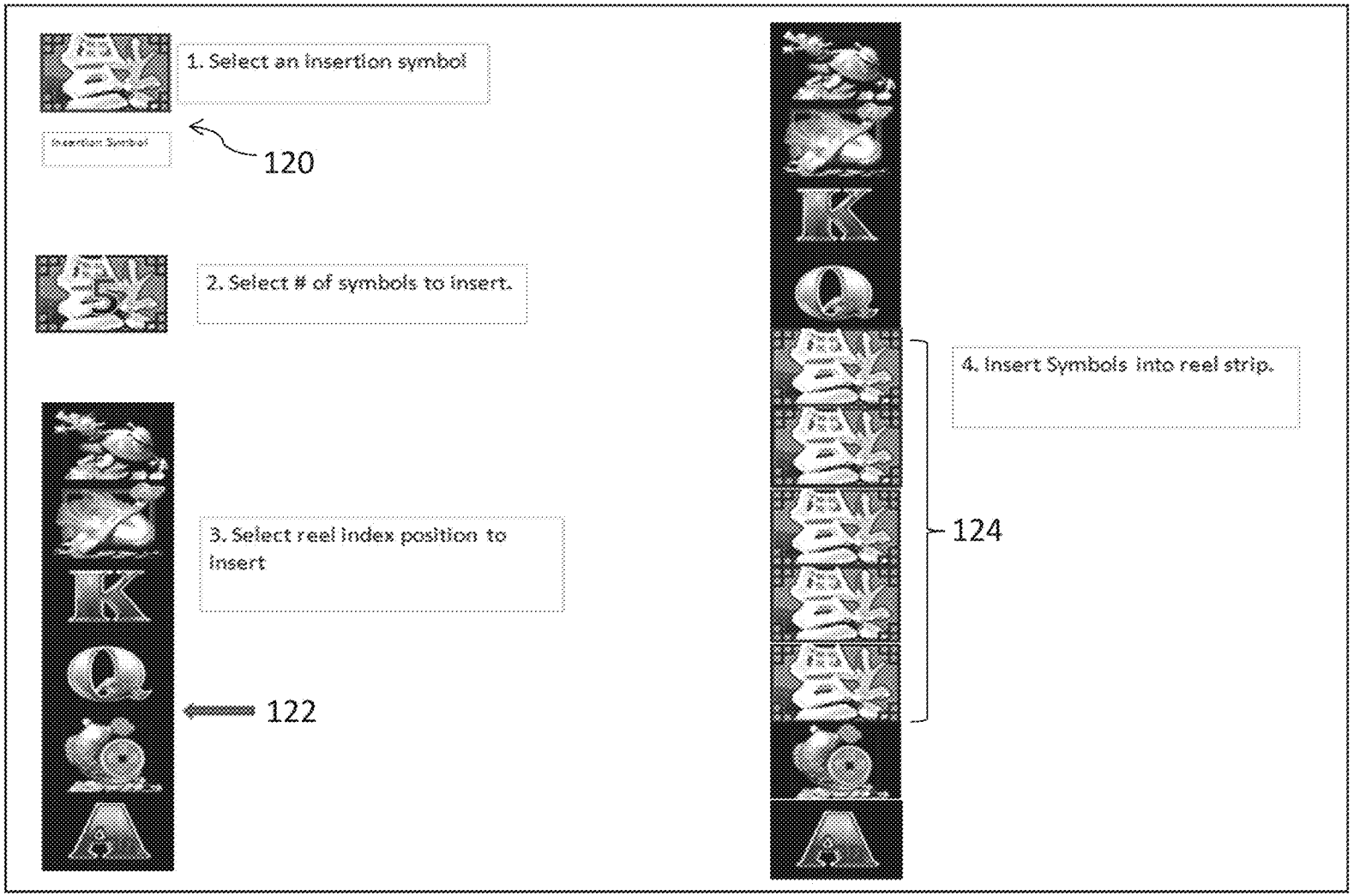
FIG. 12 is a representation of the dynamic reel allocation embodiment of the present invention.

An example of the game flow is shown in FIG. 12 for one reel.

In another aspect of the aspect of the present invention, a game machine is provided. The machine comprises a display device 12 and a gaming controller 16. The display device 12 is configured to display a plurality of symbol cells displayed in a grid. The grid defines a plurality of columns, each column having an associated reel, each reel having an associated reel strip, each reel strip including a plurality of symbol positions and a plurality of game symbols displayed in each of the symbol cells in a predetermined order, and an insertion symbol strip 124, the insertion symbol strip 124 having at least one identical insertion symbol 120. The gaming controller 16 is configured to randomly select an insertion point 122 along the first reel strip and place the insertion symbol strip 124 at said insertion point 122.

In another embodiment of the present invention, the insertion symbol strip 124 includes a plurality of identical insertion symbols 120.

In another embodiment of the present invention, the gaming controller 16 is configured to select the insertion symbol strip 124 from a plurality of insertion symbol strips 124. This allows the gaming machine 10 to select from multiple insertion symbol strips 124 and generate variety during gameplay.

In another embodiment of the present invention, each insertion symbol strip 124 has a different identical symbol. Also, each insertion symbol strip 124 may have a different number of consecutive symbol positions.

In another embodiment of the present invention, the insertion symbol 120 is selected from a subset of available symbols.

In another embodiment of the present invention, the gaming controller 16 is further configured to: select a number of consecutive symbol positions; generate the insertion symbol strip 124 based on the insertion symbol 120 selected and the number of consecutive symbol positions; select the insertion point along the first reel layout; and insert the insertion strip 124 at the insertion point 120. This embodiment is showing in FIG. 12. This allows for the dynamic generation of insertion symbol strips 124 during game play.

In another embodiment of the present invention, each insertion symbol 120 within the subset of symbols is assigned a probability of selection. This probability is similar to that represented in FIG. 9. Each available symbol would be assigned a probability depending on its value and any additional gaming mechanics that would require a change in the symbol's particular probability. Then, each assigned probability is used by the controller to select the insertion symbol strip 124.

In another embodiment of the present invention, the gaming controller 16 is configured to detect a trigger condition and place an insertion symbol strip 124 into at least one reel strip in response to the trigger condition. The trigger condition may be an element within the main game, a bonus feature game, or a combination of both. The trigger condition may also utilize any of the game mechanics and/or symbols available during game play.

In another embodiment of the present invention, the reel layout that responds to the trigger condition is in the left most reel strip. Alternatively, the reel layout that responds to the trigger condition may also be in at least one other reel strip. The first reel layout may be present in any one of the reel strips and in any number of reel strips (from one to all reel strips) within the game machine 10.

In another embodiment of the present invention, the trigger condition for a particular reel is based on the placement of an insertion symbol strip 124 within the leftwardly preceding reel in the grid.

In another embodiment of the present invention, the placement of an insertion symbol strip 124 within a column 87-91 constitutes a trigger condition for a subsequent column in the grid.

In another aspect of the present invention, a method of implementing a game machine including a display device 12 and a gaming controller 16 is provided. The display device 12 is configured to display a plurality of symbol cells displayed in a grid. The grid defines a plurality of columns 87-91, each column having an associated reel, each reel having an associated reel strip, each reel strip including a plurality of symbol positions and a plurality of game symbols 95 displayed in each of the symbol cells in a predetermined order, and an insertion symbol strip 124, the insertion symbol strip 124 having at least one identical insertion symbol 120. The method includes the steps of randomly selecting an insertion point 122 along the first reel strip and placing the insertion symbol strip 124 at said insertion point 122.

In another embodiment of the present invention, the insertion symbol strip 124 includes a plurality of identical insertion symbols 120 and the method further includes the step of placing the insertion symbol strip 124 at the insertion point 122.

In another embodiment of the present invention, the method further includes the step of selecting the insertion symbol strip 124 from a plurality of insertion symbol strips 124. This allows for the generation of multiple insertion symbol strips 124 during the same game play session. This can occur during a main game, a bonus feature, or resulting from a trigger condition during game play.

In another embodiment of the present invention, the method further includes the step of selecting the insertion symbol 120 from a subset of available symbols 95.

In another embodiment of the present invention, the method further includes the steps of: selecting a number of consecutive symbol positions; generating the insertion strip 124 based on the insertion symbol 120 selected and the number of consecutive symbol positions; selecting the insertion point 122 along the first reel layout; and inserting the insertion strip 124 at the insertion point 122.

In another embodiment of the present invention, the method further includes the step of assigning a probability of selection to each insertion symbol 120 within the subset of symbols 95.

In another embodiment of the present invention, the method further includes the step of using the probability to select the insertion strip 124.

In another embodiment of the present invention, the method further includes the steps of detecting a trigger condition and placing an insertion symbol strip 124 into at least one reel strip in response to the trigger condition. The trigger condition may be an element within the main game, a bonus feature, or a combination of both. The trigger condition may also utilize any of the game mechanics and/or symbols available during game play.

In another aspect of the present invention, a non-transitory information recording medium containing a computer readable program that functions as a game machine is provided. The machine comprises a display device 12 and a gaming controller 16. The display device 12 is configured to display a plurality of symbol cells 95 displayed in a grid. The grid defines a plurality of columns 87-91, each column having an associated reel, each reel having an associated reel strip, each reel strip including a plurality of symbol positions and a plurality of game symbols 95 displayed in each of the symbol cells in a predetermined order, and an insertion symbol strip 124, the insertion symbol strip 124 having at least one identical insertion symbol 120. The gaming controller 16 is configured to randomly select an insertion point 122 along the first reel strip and place the insertion symbol strip 124 at said insertion point 122.

The elements comprising the matrix of elements 86 of any of the above described embodiments may be of conventional rectangular configuration, but in at least one preferred embodiment the delineation of an element, that is, the boundary defining the field containing a symbol, may be any N-sided figure, where N may take the value 1 (thus a circular field) or any value from 3 to 20. In at least one preferred form of N-sided element, as shown in FIGS. 7 and 8, the elements 116 are hexagon shape for the value of N=6.

Stand-Alone Gaming Machines

As shown in FIG. 1, any of the above described embodiments for use on electronic display gaming machines may be incorporated into a stand-alone gaming machine 10 provided with a single display unit 12. In this implementation of games according to the invention, both main games and feature games (if offered) are displayed on the single display unit.

Stand-Alone Gaming Machines with Secondary Display Unit

In a further preferred embodiment of the invention as shown in FIG. 1, a stand-alone gaming machine 10 is provided with a secondary display unit 58 as well as a first display unit 54. In this embodiment the main game played on the primary display unit may take the form of either the first or second preferred embodiments described above. It is then a triggering event in the main game which offers a player a feature game as described in the third preferred embodiment above.

Gaming Machines Linked to Progressive Jackpot System

Figure 13:
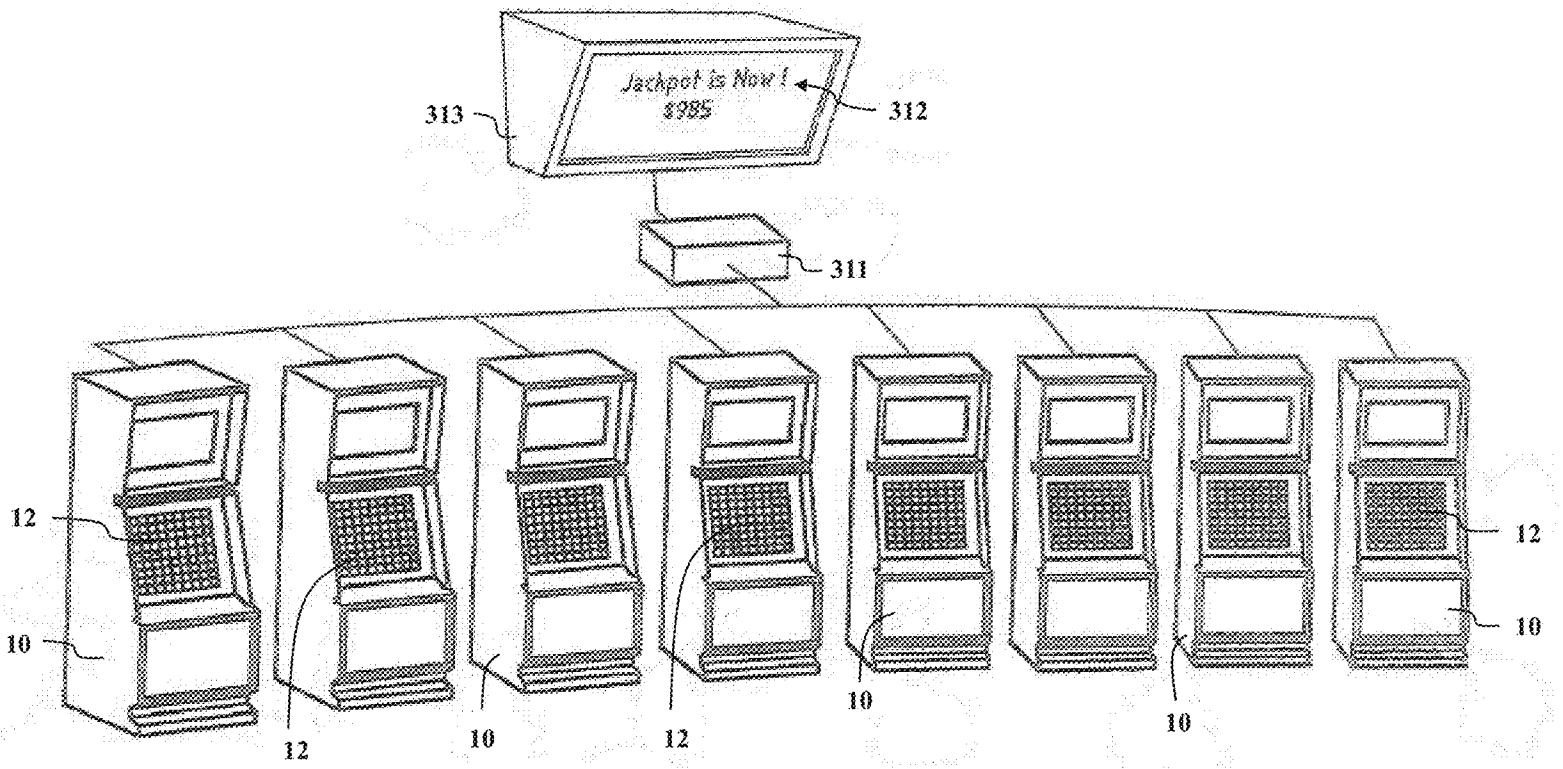
FIG. 13 is a drawing of multiple game machines connected to a progressive jackpot system, according to one industrial embodiment of the invention.

In yet a further preferred embodiment of the invention as shown in FIG. 13, a plurality of gaming machines 10 are arranged side by side in a line or arc so as to allow each of the players (not shown) of the machines to view a common jackpot prize display unit 313. Each individual machine 10 is provided with at least a display unit 12 for the playing of a main game according to the above described embodiments.

Each of machines 10 of the embodiment illustrated in FIG. 13 is electronically linked to a jackpot control module 311 which monitors the volume of play on each of the linked machines and displays an incrementing jackpot value 312 determined according to the combined volume of play on the linked machines.

A win of the jackpot prize may be triggered by specific outcomes of either a main game or of a feature game. If the jackpot trigger is dependent on an outcome of the feature game, players on adjoining machines may be made aware by means of the common display that a potential triggering of the jackpot is to commence on the machine offered the feature game, thus adding interest for all the players.

It will be appreciated that the linked machines may form part of Local Area Networks (LAN) or Wide Area Networks (WAN).

Elements of the Embodiments Generally

Exemplary embodiments of these systems and methods are described above in detail. The systems and methods are not limited to the specific embodiments described herein, but rather, components of the systems and/or steps of the methods may be utilized independently and separately from other components and/or steps described herein. For example, the systems may also be used in combination with other systems and methods, and is not limited to practice with only the system and method as described herein.

The gaming controller 16 and likewise any computing device, or computer, such as described herein, may include at least one or more processors or processing units and a system memory. The gaming controller may typically also include at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention may be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A game machine, comprising:

a display configured to display a plurality of symbol cells displayed in a grid using computer generated graphics, the grid defining a plurality of columns; and a controller in communication with the display, the controller including a processor programmed to:

associate a reel with each column, each reel having an associated reel strip, each reel strip including a plurality of symbol positions and a plurality of game symbols displayed in each of the symbol cells in a predetermined order defining a first reel layout, at least one of the reel strips having a plurality of second reel layouts, each of the second reel layouts having at least one identical symbol in a plurality of consecutive symbol positions, each second reel layout including a number of consecutive symbol positions displaying a corresponding identical symbol and having a probability of selection;

play an instance of a game including spinning and stopping the reels using the first reel layout;

randomly select one of plurality of second reel layouts as a function of the probability;

replace the first reel layout with the selected one of the plurality of second reel layouts in the at least one reel; and play a second instance of the game including spinning and stopping the reels using the second reel layout and any remaining first reel layouts.

2. The game machine, as set forth in claim 1, wherein the identical symbol within each of the second reel layouts is selected from a subset of available symbols.

3. The game machine, as set forth in claim 1, wherein the identical symbol within each of the second reel layouts is randomly selected from a subset of available symbols.

4. The game machine, as set forth in claim 3, wherein each symbol in the subset of available symbols has an associated probability, wherein the identical symbol within each of the second reel layouts is selected as a function of the associated probabilities.

5. The game machine, as set forth in claim 1, wherein the plurality of consecutive symbol positions in each of the second reel layouts has a respective number of consecutive symbol positions, wherein the number of consecutive symbols in one of the second reel layouts is different than the number of consecutive symbols in another one of the second reel layouts.

6. The game machine, as set forth in claim 1, wherein the plurality of consecutive symbol positions in each of the second reel layouts has a respective number of consecutive symbol positions, wherein the number of consecutive symbols in each of the second reel layouts is equal.

7. The game machine, as set forth in claim 1, wherein the plurality of consecutive symbol positions in each of the second reel layouts has a predetermined location within the respective second reel layout, wherein the location of the plurality of consecutive symbol positions in each second reel layout is equal.

8. The game machine, as set forth in claim 1, wherein the plurality of consecutive symbol positions in each of the second reel layouts has a predetermined location within the respective second reel layout, wherein the location of the plurality of consecutive symbol positions in one of the second reel layouts is different than the location of the plurality of consecutive symbol positions in another one of the second reel layouts.

9. The game machine, as set forth in claim 1, wherein the plurality of consecutive symbol positions in each of the second reel layouts has a predetermined location within the respective second reel layout, wherein the location of the plurality of consecutive symbol positions in each of the second reel layouts is equal.

10. The game machine, as set forth in claim 1, wherein the probability associated with at least one of the second reel layouts is different than the probability associated with another one of the second reel layouts.

11. A method, comprising:

displaying, on a display, a plurality of symbol cells displayed in a grid using computer generated graphics, the grid defining a plurality of columns;

associating by a controller in communication with the display, a reel with each column, each reel having an associated reel strip, each reel strip including a plurality of symbol positions and a plurality of game symbols displayed in each of the symbol cells in a predetermined order defining a first reel layout, at least one of the reel strips having a plurality of second reel layouts, each of the second reel layouts having at least one identical symbol in a plurality of consecutive symbol positions, each second reel layout including a number of consecutive symbol positions displaying a corresponding identical symbol and having a probability of selection;

playing, by the controller, an instance of a game including spinning and stopping the reels using the first reel layout;

randomly, by the controller, selecting one of plurality of second reel layouts as a function of the probability;

replacing, by the controller, the first reel layout with the selected one of the plurality of second reel layouts in the at least one reel; and playing, by the controller, a second instance of the game including spinning and stopping the reels using the second reel layout and any remaining first reel layouts.

12. The method, as set forth in claim 11, wherein the identical symbol within each of the second reel layouts is selected from a subset of available symbols.

13. The method, as set forth in claim 11, wherein the identical symbol within each of the second reel layouts is randomly selected from a subset of available symbols.

14. The method, as set forth in claim 13, wherein each symbol in the subset of available symbols has an associated probability, wherein the identical symbol within each of the second reel layouts is selected as a function of the associated probabilities.

15. The method, as set forth in claim 11, wherein the plurality of consecutive symbol positions in each of the second reel layouts has a respective number of consecutive symbol positions, wherein the number of consecutive symbols in one of the second reel layouts is different than the number of consecutive symbols in another one of the second reel layouts.

16. The method, as set forth in claim 11, wherein the plurality of consecutive symbol positions in each of the second reel layouts has a respective number of consecutive symbol positions, wherein the number of consecutive symbols in each of the second reel layouts is equal.

17. The method, as set forth in claim 11, wherein the plurality of consecutive symbol positions in each of the second reel layouts has a predetermined location within the respective second reel layout, wherein the location of the plurality of consecutive symbol positions in each second reel layout is equal.

18. The method, as set forth in claim 11, wherein the plurality of consecutive symbol positions in each of the second reel layouts has a predetermined location within the respective second reel layout, wherein the location of the plurality of consecutive symbol positions in one of the second reel layouts is different than the location of the plurality of consecutive symbol positions in another one of the second reel layouts.

19. The method, as set forth in claim 11, as set forth in claim 1, wherein the plurality of consecutive symbol positions in each of the second reel layouts has a predetermined location within the respective second reel layout, wherein the location of the plurality of consecutive symbol positions in each of the second reel layouts is equal.

20. The method, as set forth in claim 11, wherein the probability associated with at least one of the second reel layouts is different than the probability associated with another one of the second reel layouts.

* * * * *